US005952600A

United States Patent [19]

Herr

[11] Patent Number: 5,952,600

[45] Date of Patent: Sep. 14, 1999

[54] ENGINE DISABLING WEAPON

[76] Inventor: Jan Eric Herr, P.O. Box 15044, San Diego, Calif. 92175

[21] Appl. No.: 08/806,014

[22] Filed: Feb. 24, 1997

Related U.S. Application Data

[63] Continuation-in-part of application No. 08/597,395, Feb. 8, 1996, Pat. No. 5,675,103.

[51] Int. Cl.[6] ..... H01T 23/00

[52] U.S. Cl. ..... 89/1.11; 361/213; 361/232

[58] Field of Search ..... 89/1.11; 42/1.08; 361/213, 232; 307/149

[56] References Cited

U.S. PATENT DOCUMENTS

| | | | |
|---|---|---|---|
| 3,719,829 | 3/1973 | Vaill | 307/149 |
| 3,775,638 | 11/1973 | Tidman | 315/36 |
| 4,017,767 | 4/1977 | Ball | 361/117 |
| 4,453,196 | 6/1984 | Herr | 361/232 |
| 5,175,664 | 12/1992 | Diels et al. | 361/113 |
| 5,293,527 | 3/1994 | Sutton et al. | 340/825 |
| 5,503,059 | 4/1996 | Pacholok | 89/1.11 |

*Primary Examiner*—Charles T. Jordan
*Assistant Examiner*—Christopher K. Montgomery
*Attorney, Agent, or Firm*—Henri J. A. Charmasson; John D. Buchaca

[57] ABSTRACT

A non-lethal weapon for disabling an engine such as that of a fleeing car by means of a high voltage discharge that perturbs or destroys the electrical circuits. The transmission of the disabling voltage to the distant target is via two channels of electrically conductive air. The conductive channels are created by multi-photon and collisional ionization within the paths of two beams of coherent (laser) or collimated incoherent ultraviolet radiation directed to the target. A single beam may be used when the high voltage source and the target are grounded. The high-voltage current flows from electrodes at the origin of the beams along the channels of free electrons within them.

18 Claims, 3 Drawing Sheets

ENGINE DISABLING WEAPON

PRIOR APPLICATION

This is a continuation-in-part application of application Ser. No. 08/597,395 filed Feb. 8, 1996, now U.S. Pat. No. 5,675,103, issued Oct. 7, 1997.

FIELD OF THE INVENTION

This invention relates to weapons and more particularly to a type of non-disabling weapon which may be used by military personnel or law enforcement agents for the temporary immobilization of a target subject or subjects. The invention also relates to muscle tissue involuntary contraction by application of electric current identical to or closely approximating the physiological neuroelectric impulses which control muscle movements. This weapon may further be used to stop an automobile or other vehicle by disabling the electronic circuits which control its engine.

BACKGROUND OF THE INVENTION

To this date, the known non-lethal and sub-lethal electrical weapons that have been designed to render a target subject less than completely functional have relied on low-frequency, high-voltage currents to shock, stun, or disorient said target subject. An early example of such a device is disclosed in U.S. Pat. No. 3,803,463, to Cover. This device is a handheld weapon from which two small projectiles are fired at the target subject. Each projectile is attached to a fine conductive wire so as to deliver an electrical current to stun said target subject. The principal drawback of this type of device is that only a single shot can be fired without reloading. The weapon is thus of little value if it must be used against multiple targets, if one or both projectiles misses the target, or if the target subject is able to dislodge one or both of the projectiles or their wires before the stunning current is activated. Further, the weapon is classified as a firearm because the projectiles are propelled by nitrocellulose powder charges, and it is therefore subject to all the legal restrictions applied to firearms.

To overcome these difficulties, several non-lethal weapons have been proposed which project two parallel streams of electrically conductive liquid at the target subject. These streams are maintained at different potentials so as to complete a circuit when they contact a target subject and thereby stun said target subject with a series of very low frequency electrical pulses of about 10,000 volts each. Such weapons are disclosed, for example, in U.S. Pat. No. 3,971,292, Paniagua; U.S. Pat. No. 4,486,807, Yanez; U.S. Pat. No. 4,846,044, Lahr; U.S. Pat. No. 4,852,454, Batchelder; U.S. Pat. No. 4,930,392, Wilson; and U.S. Pat. No. 5,103,366, Battochi. The main disadvantage of these weapons is that they can be fired only a few times without reloading. A second disadvantage is that, like the earlier projectile-and-wire device, all these weapons create painful muscle spasms in the target subject that may cause injury, and invite legal action against the users. A third disadvantage is that capillary instability causes the liquid streams to break up into droplets after a short distance. A fourth disadvantage is that gravity quickly pulls such liquid streams into a ballistic arc, thus making aiming difficult. A fifth disadvantage is that the ionic flow within liquid electrolytes provides only weak electrical conductivity. A sixth disadvantage is that the target subject may be wetted by the liquid streams so that the current is short-circuited and unable to stun the subject. A seventh disadvantage is that the electro-mechanical nature of these devices and the corrosive liquids they employ tend to shorten their useful life.

Tetanization is the stimulation of muscle tissue by a rapid series of electrical impulses of such frequency as to fuse individual muscle contractions into a single sustained contraction. Tetanization is a well-known phenomenon: see Offner, "Stimulation With Minimum Power," Journal of Neurophysiology, Vol. 9, pp. 387–390, 1946; Dalziel, "Effect of Wave Form on Let-go Currents," AIEE Transactions, Vol. 62, pp. 739–744, 1943; Dalziel and Lee, "Lethal Electrical Currents," IEEE Spectrum, Vol. 6, pp. 44–50, 1969; Dalziel, Ogden, and Abbott, "Effect of Frequency on Let-go Currents," AIEE Transactions, Vol. 62, pp. 745–750, 1943; Kouwenhoven, Hooker and Lotz, "Electrical Shock Effects of Frequency," Electrical Engineering, Vol. 55, pp. 384–386, 1936; and Ferris et al., "Effects of Electrical Shock on the Heart," Electrical Engineering, Vol. 55, pp. 498–515, 1936.

The present invention also results from prior experiences in the laser-induced ionization of air as described by Koopman and Wilkerson, "Channeling of Ionizing Electrical Streamer by a Laser Beam," Journal of Applied Physics, Vol. 42, pp. 1883–1886, 1971, and Koopman and Saum, "Formation and Guiding of High-Velocity Electrical Streamers by Laser-Induced Ionization," Journal of Applied Physics, Vol. 44, pp. 5328–5336, 1973. Prior applications of laser-induced ionization can be found in U.S. Pat. No. 3,719,829, Vaill and U.S. Pat. No. 3,775,638, Tidman which disclose methods of creating a conductive path in a gas, U.S. Pat. No. 4,017,767 Ball and U.S. Pat. No. 4,453,196 Herr which disclose the transmission of electricity via laser-ionized air channels, and U.S. Pat. No. 5,175,664 Diels et al. which discloses methods of creating conductive paths of ionized air by means of laser beams toward the goal of discharging storm clouds.

This invention also relates to devices used to damage or destroy electronic circuits at a distance. Because such circuits now control many internal combustion engines, high-voltage currents or pulses which damage those circuits necessarily disable the engines they govern. One commercial application is the stopping of fleeing automobiles quickly without causing injury to the passengers or bystanders. High voltages are required because the current must reach ground across a gap of about ten centimeters between the automobile's wheel rims and the roadbed. Because the breakdown voltage of dry air is about 32 kV $cm^{-1}$, the potential difference between the wheel rims and the ground is approximately 320 kv. As disclosed by U.S. Pat. No. 5,503,059, prior means of stopping an automobile with an external electric current include placing a conductive pad in its path. As the vehicle passes over, the pad delivers a powerful electric impulse to it and thus to its electronic components. This method has the obvious disadvantage of the user having to choose and reach an effective location before the automobile's arrival. The same U.S. Patent also discloses two other means of conveying an electric current to a moving vehicle. The first is by contacting its undercarriage with metal rods that project from the pursuing police car. The second is by firing into the fleeing auto a harpoon with trailing wires which then transmit electric pulses to it. Each of those methods lacks satisfactory range and the ability to continuously target a moving vehicle. Another prior means utilizes microwave pulses that are directed toward the automobile from an antenna on the pursuing police car. According to U.S. Pat. No. 5,293,527, the width of the beam intended to achieve this goal is approximately 50°. A microwave pulse of this width would not only dissipate too rapidly to be effective at any reasonable distance, but would probably affect other vehicles as well.

The instant invention results from a search for a weapon that would be more efficient in conducting electrical discharges to a distant vehicle within a greater range for a more precise and continuous targeting.

SUMMARY OF THE INVENTION

The principal object of the instant invention is to provide a non-lethal immobilizing weapon for use by military or law enforcement personnel.

A second object of this invention is to provide a non-lethal, immobilizing weapon which is inherently safe in its operation.

A third object of this invention is to provide a non-lethal weapon which is capable of temporarily immobilizing a target subject without causing pain, shock, disorientation, or loss of consciousness.

A fourth object of this invention is to provide a non-lethal weapon which is capable of temporarily immobilizing a target subject without his being aware of the cause.

A fifth object is to provide a non-lethal, immobilizing weapon whose range is substantially greater than prior related weapons that use wires or conductive liquid streams.

A sixth object is to provide a non-lethal, immobilizing weapon which can be fired from a remote location without requiring the physical impact of solid or liquid matter upon the target.

A seventh object is to provide a non-lethal, immobilizing weapon which can be directed continuously and swept across an indefinitely large number of target subjects.

An eighth object is to provide a non-lethal, immobilizing weapon which can rapidly be fired toward a specific location on a single target subject, or to a specific target subject among many because of the highly directional nature of its current-conducting means.

A ninth object is to provide a non-lethal, immobilizing weapon which has a significantly longer service life than prior related weapons.

These and other objects are achieved by transmitting relatively high frequency electrical impulses to the target by means of one or two electrically conductive channels of ionized air produced within one or two beams of intense ultraviolet radiation aimed at the target, and by placing a high-voltage field of the opposite polarity across the path of each beam.

The present invention functions by immobilizing the target person or animal at a distance. It performs this function by producing skeletal muscle tetanization in the target subject. Tetanization is the stimulation of muscle tissue by a series of electrical impulses of such frequency as to merge individual muscle contractions into a single sustained contraction. The immobilizing tetanization is maintained as long as the weapon continues to produce an electrical current within a major portion of the skeletal musculature of the subject, and for a brief time thereafter due to paralysis caused by the temporary inhibition of neuromuscular impulses. The optimum current and frequency required to create and maintain immobility while avoiding impairment of cardiac or respiratory activity are 25 milliamperes and 100 hertz, respectively. Currents in the range of 20 to 50 milliamperes and 1 to 10,000 hertz may also be employed, with the higher frequencies requiring higher currents. A frequency of about 2 hertz may ultimately be used to produce painful spastic contractions. A minimum electrical potential of approximately 600 volts is required to overcome skin resistance without producing burns.

The most effective current waveform in producing tetanization is that which most closely duplicates the physiologically produced neural impulse. As Offner points out, this waveform is an exponentially rising pulse. The second most effective waveform is a square wave, whereas the least effective is a sine wave. Due to their rapid rise-times, square waves allow the greatest penetration through the clothing and skin of the target subject.

Further, the differences in the effectiveness of various waveforms constitute an inherent safety factor in the operation of the instant weapon. This safety factor is a result of the rapid absorption by biological tissue of the harmonic frequencies within complex waveforms such as square waves. A 20 to 50 milliampere current is thus able to stimulate only the target subject's skeletal muscles, and cannot penetrate to the autonomically-controlled internal muscles such as the heart.

A lethal variation of the present weapon could be implemented by increasing the current above approximately 250 milliamperes. A sine wave current having a density of about 5 milliamperes per square centimeter that flows through cardiac muscle for more than about two seconds may initiate ventricular fibrillation. The duration of the current needed to cause ventricular fibrillation is inversely proportional to the current density within the cardiac muscle.

The current carried by the ionized air channel is limited by the number of free electrons within the ultraviolet beam. A minimum 20 milliampere current required to induce skeletal muscular tetanization can be carried by a gaseous channel with a concentration of $10^8$ ions per cubic centimeter. This concentration is most efficiently achieved in air by ionizing molecular oxygen with coherent or collimated incoherent ultraviolet radiation having a wavelength of approximately 193 nanometers. Shorter wavelengths may be employed as optical technology progresses.

At its normal operating intensity and a wavelength near 193 nanometers, the ultraviolet beam is safe to the skin because it cannot produce more than mild erythema akin to a sunburn unless it is directed at the same location for many minutes. Moreover, it is safe to the eyes because wavelengths near 193 nanometers cannot penetrate the cornea to reach internal ocular structures such as the lens and retina.

At this wavelength, molecular oxygen has a two-photon ionization cross section of $1\times10^{-34}$ $cm^4$/watt. Because of its low ionization threshold, the number of photons required for ionization, and its large proportion in the atmosphere, it is easily able to create sufficient electron density.

The most efficient source of 193-nanometer radiation presently available is the argon fluoride discharge-pumped excimer laser. A reasonable power density, pulse duration, and pulse repetition rate for this laser is 5 megawatts per square centimeter, 10 nanoseconds, and 200 pulses per second, respectively.

An argon fluoride laser with an aperture of 1 square centimeter has a power density (energy output) of 10 millijoules per pulse or 1 megawatt per square centimeter. Each pulse liberates $6.3\times10^6$ electrons, or $6.3\times10^{14}$ electrons per second in the air immediately outside the aperture. A power density of 50 millijoules per pulse or 5 megawatts per square centimeter liberates $1.6\times10^8$ electrons during each pulse, which is equivalent to $1.6\times10^{16}$ electrons per second.

A narrow beam of ultraviolet radiation may also be generated from the collimated emission of an ultraviolet lamp.

The electron density in the channel of ionized air is a function of the ratio between the electron production and loss rates. In both the two-body and three-body electron attachment processes, the delay time between the end of the laser pulse and the beginning of the high-voltage tetanizing pulse determines the number of available electrons. When the electron energy is only 0.1 electron volt, for example, the three-body attachment is rapid, and the steady-state electron density for a 193 nanometer, 5 megawatt per square centimeter beam falls to $8\times10^7$ per cubic centimeter.

The range of the present weapon is determined by the rate at which the laser beam is absorbed by the atmosphere. A 193-nanometer wavelength beam is attenuated in dry air at about $1\times10^{-4}$ per centimeter. It will thus propagate approximately 100 meters before its intensity is decreased to l/e of its initial value. As a consequence, the $1.6\times10^8$ electron density at the aperture of an argon fluoride laser with a power density of 5 megawatts per square centimeter falls to $2.2\times10^7$ after 100 meters. Because the minimum electron density required to transmit a current is between $10^6$ and $10^8$ per cubic centimeter, the above ionized channel should conduct the tetanizing current at least 100 meters. The range of this weapon could be increased, however, by the use of a more efficient ultraviolet source.

Various techniques, including those suggested in U.S. Pat. No. 4,017,767 Ball and U.S. Pat. No. 5,175,664, Diels et al. which are incorporated herein by reference, may be used in order to enhance the multi-photon and collisional ionization along the laser beams. These techniques are well known to persons skilled in the electrical arts.

The engine-disabling application of the invention creates high voltage discharge in the proximity of a vehicle engine either by using the vehicle body as a shorting means between either voltage-carrying beam and the ground or a pair of voltage-carrying beams.

DESCRIPTION OF THE PREFERRED EMBODIMENT OF THE INVENTION

Figure 1:
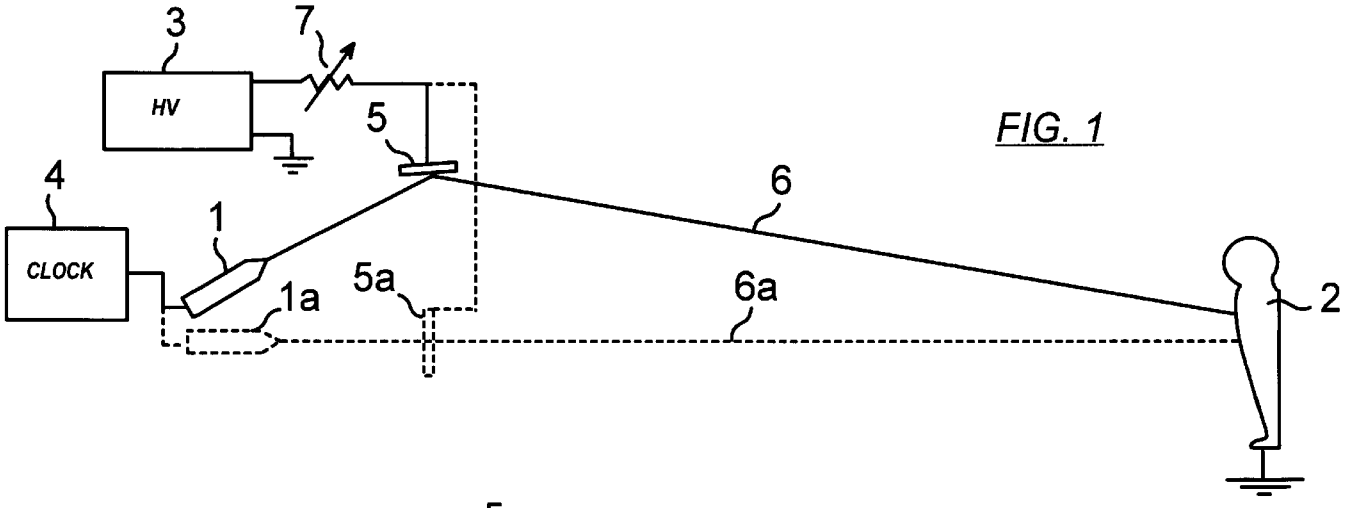
FIG. 1 is a diagrammatical illustration of a first embodiment of the invention.

Referring now to the drawings and more specifically to FIG. 1, there is illustrated a first embodiment of the invention. A high-intensity source of coherent or collimated incoherent ultraviolet radiation, typically operating in a pulsed mode such as a pulsed laser 1, directs a photon beam 6 having a wavelength of preferably and approximately 193 nanometers toward a grounded human or animal target 2. A channel of ionized air is created within the photon beam 6 according to multi-photon, collisional, and other ionization processes. A high-voltage tetanizing pulse generator 3 has one of its output terminals connected to an electrically conductive mirror 5 or an electrically conductive transparent plate 5*a*, interposed in the path of the photon beam 6 or 6*a*. The second terminal of the high-voltage pulse generator 3 is connected to ground. A variable resistor 7 is mounted in series with one of the terminals of the high-voltage pulse generator 3 and controlled by a feedback circuit to maintain a constant current through the target 2. A clocking circuit 4 produces the synchronized triggering signals for both the pulsed laser 1 and the high-voltage pulse generator 3.

Assuming that a sufficient number of free electrons are created by the multi-photon, collisional, and other ionization processes between the mirror 5 or plate 5*a* and the target 2, an electrical path for the high-voltage pulses issuing from the generator 3 is provided to the body of the human or animal target 2.

Figure 2:
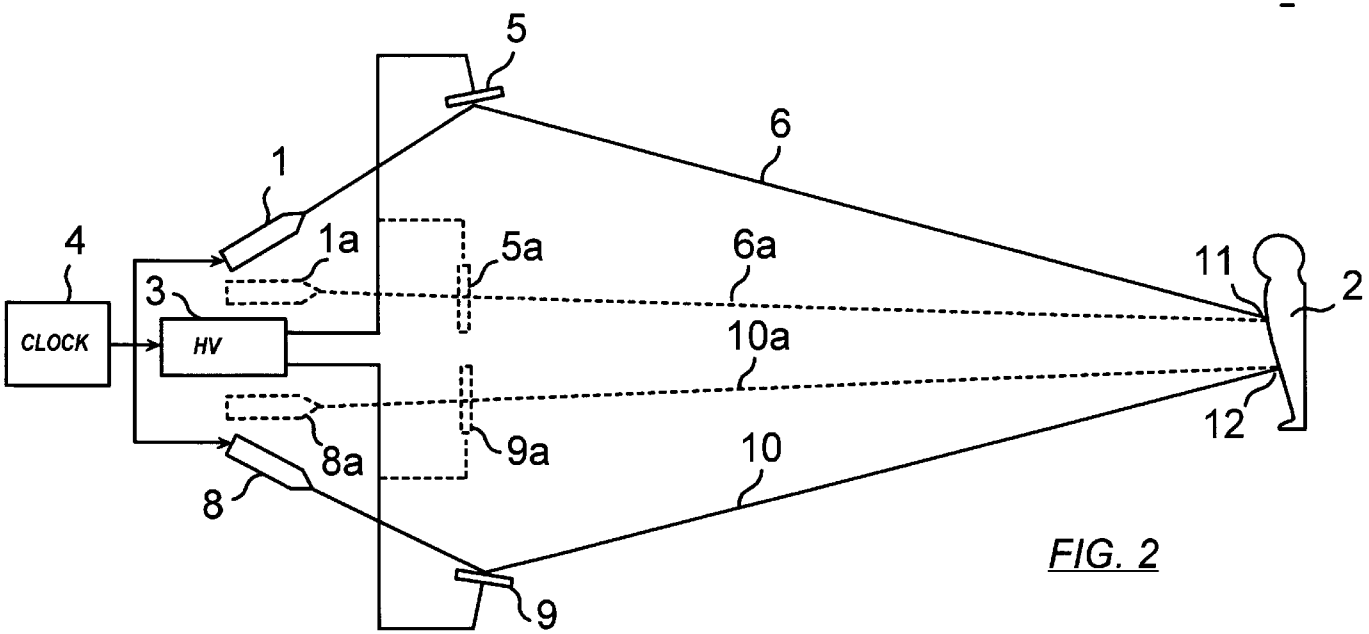
FIG. 2 is a diagrammatical illustration of a second embodiment of the invention.

In the second embodiment of the invention illustrated in FIG. 2, a second laser 8 is used to create the return path of the electrical circuit in place of the ground connection. The second terminal of the high-voltage pulse generator 3 is connected to a second electrically conductive mirror 9 or electrically conductive transparent plate 9*a* interposed in the path of the second laser beam 10. The laser beams 6 and 10 are directed to impinge upon the human or animal target 2 in two locations 11 and 12 between which the high-voltage tetanizing current is to flow. Assuming that sufficient free electrons are created in each of the ionized air channels between the mirror 5 or plate 5*a* and the location 11 on the target on one part, and the mirror 9 or plate 9*a* and the location 12 on the target on the other part, an electrical path for the high-voltage pulsed current is provided. This electrical path includes a portion of the target subject 2. The firing of the lasers 1 or 8 and the activation of the high-voltage pulse generator 3 are synchronized by means of the clocking circuit 4.

Figure 3:
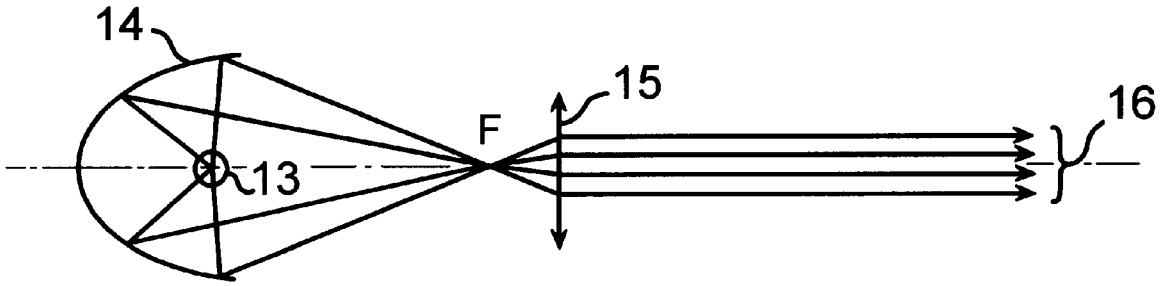
FIG. 3 is a diagrammatical illustration of an ultraviolet beam generating system using a UV lamp.

FIG. 3 is a diagrammatical illustration of a ultraviolet beam generating system wherein the radiation from a UV lamp 13 is focused by a parabolic reflector 14 on the focal center of a lens 15. The beam 16 of parallel ultraviolet rays is used to ionize an air channel.

Figure 4:
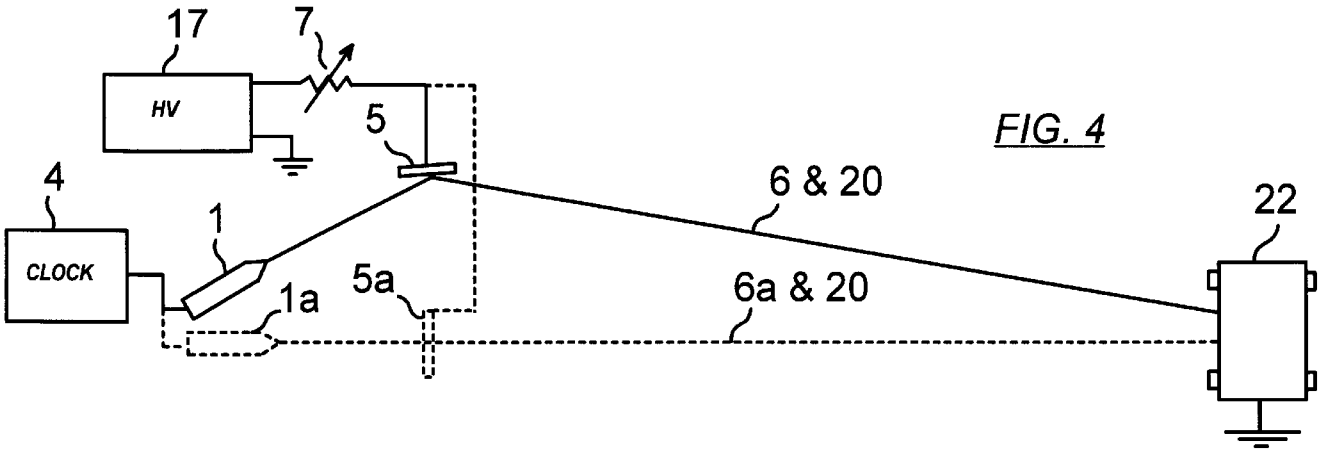
FIG. 4 is a diagrammatical illustration of a third embodiment of the invention.

FIG. 4 illustrates a third embodiment of the invention. This embodiment uses the high-voltage (not the tetanizing) aspect of the invention against electronic circuits, especially those of vehicles. A high-intensity source of coherent or collimated incoherent ultraviolet radiation, typically operating in a pulsed mode such as a pulsed laser 1, directs a photon beam 6 having a wavelength of preferably and approximately 193 nanometers toward a vehicle 22. A channel of ionized air is created within the photon beam 6 according to multi-photon, collisional, and other ionization processes. A high-voltage capacitor bank or Marx generator 17 has its output terminal connected to either an electrically conductive mirror 5, or an electrically conductive transparent plate 5*a*, interposed in the path of either the photon beam 6 or 6*a* respectively.

Assuming that a sufficient number of free electrons are created by the multi-photon, collisional, and other ionization processes between the mirror 5 or plate 5*a* and the vehicle 22, an electrical path for the high-voltage direct current pulses issuing from the capacitor bank or Marx generator 17 is provided to the vehicle 22. These pulses travel through the metal portions of the vehicle 22 to its wheel rims and thence to ground. The return path of the circuit is through ground to the opposite terminal of the capacitor bank or Marx generator 17. Because of their high potential and changing nature, the pulses induce secondary currents in the vehicle's electronic circuits, thus damaging their voltage-sensitive components. The photon beam 6 or 6*a* is directed automatically, as by a radar-controlled servomechanism 19 (not shown), or by the manual alignment of a beam of visible light 20 that is coaxial with the ultraviolet photon beam 6 or 6*a*.

Figure 5:
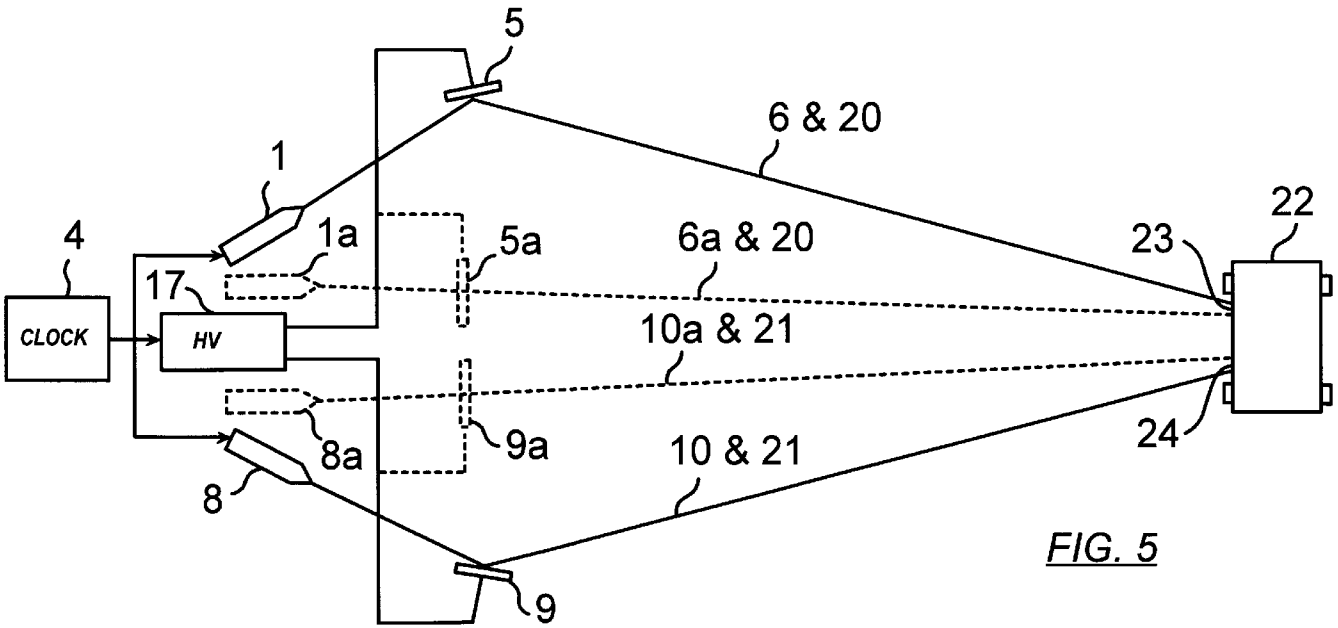
FIG. 5 is a diagrammatical illustration of a fourth embodiment of the invention.

FIG. 5 illustrates a fourth embodiment of the invention for use against electronic circuits, especially those of vehicles.

A second laser 8 is used to create a return path for the electrical current. Each of the terminals of a high-voltage alternating current generator 18 are connected either to electrically conductive mirrors 5 and 9, or to electrically conductive transparent plates 5*a* and 9*a* that are interposed respectively in the paths of the photon beams 6 and 10. The photon beams 6 and 10 are directed to impinge upon the target vehicle 22 in two locations 23 and 24 between which the high-voltage alternating current is to flow. Assuming that sufficient free electrons are created between the mirror 5 or plate 5*a* and the location 23 on one part of the vehicle 22, and the mirror 9 or plate 9a and the location 24 on another part of the vehicle, an electrical path for high-voltage alternating current is provided. This electrical path should include the greater portion of the vehicle 22, which presumably would contain the majority of its electronic circuits. Because of its high potential and changing nature, the primary alternating current induces secondary currents in the vehicle's electronic circuits, thus damaging their voltage-sensitive components. Therefore, the primary current is adjusted to cause these secondary currents through electrical induction. The primary current may be further adjusted to maximize the disabling nature of the secondary currents depending on known or suspected characteristics of the target circuit. The photon beams 6 and 10 are directed automatically, as by a radar-controlled servomechanism 19 (not shown), or by the manual alignment of beams of visible light 20 and 21 that are coaxial with the ultraviolet photon beams 6 and 10.

Alternately, the photon beams 6 and 10 are directed to converge in the air above the engine compartment of the vehicle 22. The high-voltage alternating current is therefore conducted to a point immediately above that part of the vehicle 22 in which the majority of its electronic circuits are located. Because of its high potential and changing nature, the alternating current induces transient currents in the automobile's electronic circuits, thus damaging their voltage-sensitive components. Because a return path is provided, this embodiment may be employed from an ungrounded platform such as a helicopter or other aircraft.

It should be noted that an ultraviolet laser wavelength of 193 nanometers yield the most intensive ionization and therefore the widest channel. In most of the above-disclosed applications where distance rather than intensity is the prime requirement, it is advantageous to operate the laser at wavelenths slightly to either side of the optimal one. Typically, the laser is preferably operated within the ranges from 190.6 through 192.8 or from 193.2 through 195.4 nanometers.

It may be useful in damp weather to reduce the amount of water vapor or water droplets in the path of the ultraviolet beam. As described in U.S. Pat. No. 5,175,664 Diels et al., a more optically transparent path is created through the use of a coaxial beam of infrared radiation. This coaxial infrared beam may be produced by any of several commonly-available carbon dioxide lasers.

While the preferred embodiments of the invention have been described, modifications can be made and other embodiments may be devised without departing from the spirit of the invention and the scope of the appended claims.

What is claimed is:

1. An apparatus for generating an electrical circuit disabling high-voltage electrical discharge at a first point proximate to a distant target circuit which comprises:

means for generating a high-voltage pulsed alternating electrical current adjusted to induce secondary disabling currents in said circuit;

wherein said current has periodic positive and negative voltages;

means for ionizing at least one channel of ambient air between said means for generating and said first point; and means for applying said electrical current to said ionized channel.

2. The apparatus claimed in claim 1, wherein said means for generating comprise a high-voltage pulse-creating electronic circuit;

and wherein said means for ionizing comprise means for emitting a first beam of ultraviolet radiation.

3. The apparatus claimed in claim 2, wherein said means for applying comprises an electrically conductive mirror placed in the path of said ionized channel, said mirror being connected to a first output terminal of said high-voltage pulse-creating electronic circuit.

4. The apparatus claimed in claim 2, wherein said means for applying comprise a plate of electrically conductive, transparent material placed in the path of said beam, said plate being connected to a first output terminal of said high-voltage pulse-creating electronic circuit.

5. The apparatus claimed in claim 2 wherein said first beam has a wavelength of approximately 193 nanometers.

6. The apparatus claimed in claim 2 wherein said means for ionizing comprises a laser operated in a pulsed mode.

7. The apparatus claimed in claim 6 which further comprises means for synchronizing said high-voltage pulsed electrical current with said beam of ultraviolet radiation.

8. The apparatus claimed in claim 6 which further comprises means for emitting a second beam of ultraviolet radiation between said means for generating and a second point proximate to said target and a means for connecting a second output terminal of opposite polarity to said first terminal of said high-voltage pulse-creating electronic circuit to said second beam of ultraviolet radiation.

9. The apparatus of claim 8, wherein said target circuit is housed within an electrically conductive body, and wherein said first point is located on a first part of said body, and said second point is located on a second part of said body.

10. The apparatus claimed in claim 2, wherein said beam has a wavelength within one of the ranges from approximately 190.6 through 192.8 and from 193.2 through 195.4 nanometers.

11. The apparatus claimed in claim 2, wherein said high-voltage pulse-creating electronic circuit comprises a Marx generator having an output voltage of at least 400 kilovolts.

12. The apparatus of claim 1, wherein said target circuit is housed within an electrically conductive body, and wherein said first point is located on a part of said body.

13. A method for generating an electrical circuit disabling high-voltage electrical discharge about a distant target which comprises:

generating a high-voltage pulsed alternating primary electrical current;

wherein said current has periodic positive and negative voltages;

repetitively ionizing at least one channel of ambient air between a source of said current and a point proximate to said target by emitting a beam of ultraviolet radiation of sufficient energy to cause multi-photon ionization, said beam impinging upon both said source and said point; and discharging said source though said channel.

14. The method claimed in claim 13 wherein, said step of emitting a beam comprises using an ultraviolet source having an energy level sufficient to cause multi-photon ionization through said channel.

15. The method claimed in claim 13, wherein the frequency of said high-voltage pulses is selected between 1 and 10,000 hertz.

16. The method claimed in claim 13, wherein the step of emitting a beam comprises using an ultraviolet source having a wavelength of approximately 193 nanometers.

17. The method claimed in claim 13, wherein the step of emitting a beam comprises using an ultraviolet source having a wavelength within one of the ranges from 190.6 through 192.8 and from 193.3 through 195.4 nanometers.

18. The method of claim 13, wherein said target has an electrically conductive body and wherein said point is located on a part of said body.

* * * * *